US006053344A

United States Patent [19]

Gregory et al.

[11] Patent Number: 6,053,344

[45] Date of Patent: Apr. 25, 2000

[54] TAMPER-INDICATING CLOSURE AND METHOD OF MANUFACTURE

[75] Inventors: James L. Gregory, Toledo; Stephanie L. Kurtz, Stony Ridge, both of Ohio

[73] Assignee: Owens-Illinois Closure Inc., Toledo, Ohio

[21] Appl. No.: 09/110,020

[22] Filed: Jul. 2, 1998

[51] Int. Cl.[7] ..... B65D 39/00

[52] U.S. Cl. ..... 215/252

[58] Field of Search ..... 215/252

[56] References Cited

U.S. PATENT DOCUMENTS

| | | | |
|---|---|---|---|
| Re. 33,265 | 7/1990 | Gregory et al. . | |
| 3,904,062 | 9/1975 | Grussen . | |
| 4,033,472 | 7/1977 | Aichinger . | |
| 4,205,755 | 6/1980 | de Wijn . | |
| 4,305,516 | 12/1981 | Perne et al. | 215/252 |
| 4,402,418 | 9/1983 | Ostrowsky . | |
| 4,432,461 | 2/1984 | Mumford et al. . | |
| 4,458,821 | 7/1984 | Ostrowsky . | |
| 4,497,765 | 2/1985 | Wilde et al. | 264/268 |
| 4,530,436 | 7/1985 | Wiedmer . | |
| 4,565,295 | 1/1986 | Mori et al. . | |
| 4,573,601 | 3/1986 | Berglund . | |
| 4,595,110 | 6/1986 | Herr . | |
| 4,666,053 | 5/1987 | Corcoran et al. . | |
| 4,720,018 | 1/1988 | Schetzsle et al. . | |
| 4,744,479 | 5/1988 | Schottli | 215/252 |
| 4,807,771 | 2/1989 | Roy et al. . | |
| 5,080,246 | 1/1992 | Hayes . | |
| 5,129,530 | 7/1992 | Fuchs . | |
| 5,295,600 | 3/1994 | Kowal | 215/252 |
| 5,488,888 | 2/1996 | Kowal . | |
| 5,657,889 | 8/1997 | Guglielmini . | |
| 5,853,095 | 12/1998 | Marshall et al. | 215/252 |
| 5,893,474 | 4/1999 | Herrmann et al. | 215/252 |

FOREIGN PATENT DOCUMENTS

| | | |
|---|---|---|
| 2309499 | 9/1974 | Germany . |

*Primary Examiner*—Gregory M. Vidovich
*Assistant Examiner*—Rodrigo L Eichwald

[57] ABSTRACT

A tamper-indicating closure of integrally molded plastic construction that includes a base wall having a peripheral skirt with internal threads for engaging external threads on the finish of a container. A tamper-indicating band is connected to the lower or free edge of the skirt by a plurality of circumferentially spaced integral bridges. At least one of the bridges has a greater circumferential dimension than other of the bridges. A thin integral membrane is disposed in the band immediately circumferentially adjacent to the one bridge, and extends both axially and circumferentially of the band. A stop flange is positioned on the band for engaging a bead on a container to inhibit removal of the closure, such that the membrane and the other bridges rupture upon removal of the closure but the band remains connected to the closure by the one bridge of enlarged circumferential dimension. Provision of the thin membrane during the closure molding operation thus provides for rupture of the free end of the band to form a pigtail band configuration upon removal from the container without axial scoring or other secondary manufacturing operations that would require controlled orientation of the closure.

22 Claims, 6 Drawing Sheets

TAMPER-INDICATING CLOSURE AND METHOD OF MANUFACTURE

The present invention relates to tamper-indicating closures, to methods of manufacturing such closures, and to a package that includes such a closure on a container.

BACKGROUND AND OBJECTS OF THE INVENTION

It is conventional to form a tamper-indicating closure having a band connected to the skirt of the closure by integral frangible bridges. The band has a stop element (e.g., a bead or flange) that engages a bead on the container to resist unthreading of the closure, so that removal of the closure ruptures the frangible bridges that connect the band to the closure skirt. U.S. Pat. No. Re. 33,265, assigned to the assignee hereof, discloses a tamper-indicating closure of this character, in which the tamper-indicating band is completely severed from the closure skirt and remains with the container following removal of the closure from the container. Although tamper-indicating closures of this so called "drop-band" type have enjoyed substantial commercial acceptance and success, particularly in the U.S., it is desirable in many situations to provide for removal of the tamper-indicating band with the closure. This is particularly true, for example, where the container is to be reused, or to be recycled for manufacture of new containers. In either of these applications, it would be necessary to remove a tamper-indicating band that remains on the container after the closure has been removed.

U.S. Pat Nos. 4,432,461 and 5,295,600, both assigned to the assignee hereof, disclose tamper-indicating closures in which the tamper-indicating band remains with the closure following removal from the container. In each of these patent disclosures, the tamper-indicating band is coupled to the skirt of the closure by a plurality of bridges, one of which is sized so as to be non-frangible in normal use. In U.S. Pat. No. 4,432,461, both ends of the tamper-indicating band are connected to the closure skirt by a bridge of enlarged circumferential and/or radial dimension, so that both ends of the band remain connected to the skirt following rupture of the other bridges and removal of the closure from the container. In U.S. Pat. No. 5,295,600, an interrupted circumferential scoreline extends around the skirt and band to provide the frangible bridges between the skirt and band, and to provide the enlarged bridge between the skirt and band at the point of interruption of the scoreline. A pair of axial scorelines are provided in the tamper-indicating band circumferentially adjacent to the enlarged bridge. Thus, one end of the tamper-indicating band remains connected to the closure skirt following rupture of the frangible bridges and removal from the container, while the opposing end of the tamper-indicating band is free of connection to the skirt forming a so-called "pigtail" band.

In manufacture of tamper-indicating closures of the type disclosed in U.S. Pat. No. 5,295,600, it is necessary in the manufacturing tooling to orient the closure with respect to the score tooling so that the vertical or axial scores are properly positioned with respect to the interrupted circumferential score. It is therefore one object of the present invention to provide a pigtail-type tamper-indicating closure and method of manufacture in which the need for axial scores in the tamper-indicating band is eliminated, and in which there is no requirement or need for orienting the closure during the circumferential scoring operation. Another object of the present invention is to provide a tamper-indicating closure and method of manufacture in which the closure is adapted for use either as a pigtail-type tamper-indicating closure in which the tamper-indicating band is removed from the container with the closure, or as a drop-band type tamper-indicating closure in which the band remains on the container after removal of the closure.

SUMMARY OF THE INVENTION

A tamper-indicating closure of integrally molded plastic construction in accordance with a presently preferred embodiment of the invention includes a base wall having a peripheral skirt with internal threads for engaging external threads on the finish of a container. A tamper-indicating band is connected to the lower or free edge of the skirt by a plurality of circumferentially spaced integral bridges. At least one of the bridges has a greater circumferential dimension than other of the bridges. A thin integral membrane is disposed in the band immediately circumferentially adjacent to the one bridge, and extends both axially and circumferentially of the band. A stop element (e.g., a flange) is positioned on the band for engaging a bead on a container to inhibit removal of the closure, such that the membrane and the other bridges rupture upon removal of the closure but the band remains connected to the closure by the one bridge of enlarged circumferential dimension. Provision of the thin membrane during the closure molding operation thus provides for rupture of the free end of the band to form the pigtail band configuration upon removal from the container without axial scoring or other secondary manufacturing operations that would require controlled orientation of the closure.

In accordance with another aspect of the present invention, there is provided a tamper-indicating closure of integral as-molded plastic construction, which comprises a base wall having a peripheral skirt with internal threads for engaging external threads on the finish of a container. An annular tamper-indicating band integrally axially extends from the skirt, and a plurality of circumferentially spaced bridges are molded on an internal face of the skirt and extend axially into the band. At least one of the bridges has a greater circumferential dimension than other of the bridges but a lesser axial dimension into the band. A thin integral membrane is molded into the band circumferentially adjacent to the one bridge, and extends both axially and circumferentially of the band. A stop flange on the band engages a bead on the container to inhibit removal of the closure from the container. The closure is thus adapted to be externally scored to separate the band from the skirt, with the score being spanned by at least some of the bridges. When the circumferential score is positioned axially to engage the one band of enlarged circumferential dimension, the other bridges and the membrane are ruptured upon removal of the closure from the container, such that the closure is of a type adapted to provide a pigtail-type tamper-indicating band that is removed with the closure. When the circumferential score is positioned axially so as not to intersect or engage the one bridge of enlarged circumferential dimension, the closure is of a drop-band type in which the band is completely severed from the closure upon removal of the closure from the container, and remains with the container following removal of the closure. Thus, either a pigtail-type closure or a drop-band-type closure may be provided employing the same mold tooling and by adjustment of the position of the circumferential score into the closure skirt.

In the preferred embodiments of the invention contemplating a pigtail-type tamper-indicating closure, one, two or four circumferentially uniformly spaced bridges of enlarged circumferential dimension are provided for forming closures having one, two or four pigtails. A thin integral membrane is molded into the tamper-indicating band circumferentially clockwise adjacent to each of the enlarged bridges. The stop flange that extends from the tamper-indicating band has a circumferential interruption axially aligned with each of the integral membranes for both weakening the stop flange to facilitate rupture upon removal of the closure from the container, and to provide a gap through which mold tooling may pass for formation of the membrane(s) during and as part of the molding operation. The circumferential dimension of the enlarged bridge(s) may be between 23° and 90°, depending upon the number of bridges in the closure.

A method of making a plastic tamper-indicating closure in accordance with another aspect of the present invention contemplates compression or injection molding a closure having a base wall, a peripheral skirt, an annular tamper-indicating band, a plurality of spaced bridges, and a thin integral membrane in the band as previously described. The closure is then circumferentially scored to separate the band from the skirt, but not to separate the bridges. The scoring is so positioned axially with respect to at least one circumferentially enlarged bridge that the band is either adapted to remain on the container when the closure is removed by positioning the score so as not to intersect the enlarged bridge, or to be removed with the closure by positioning the score to intersect the enlarged bridge.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
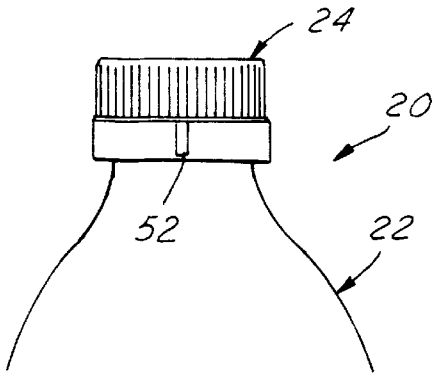
FIG. 1 is a fragmentary elevational view of a tamper-indicating package in accordance with one presently preferred embodiment of the invention.
Figure 2:
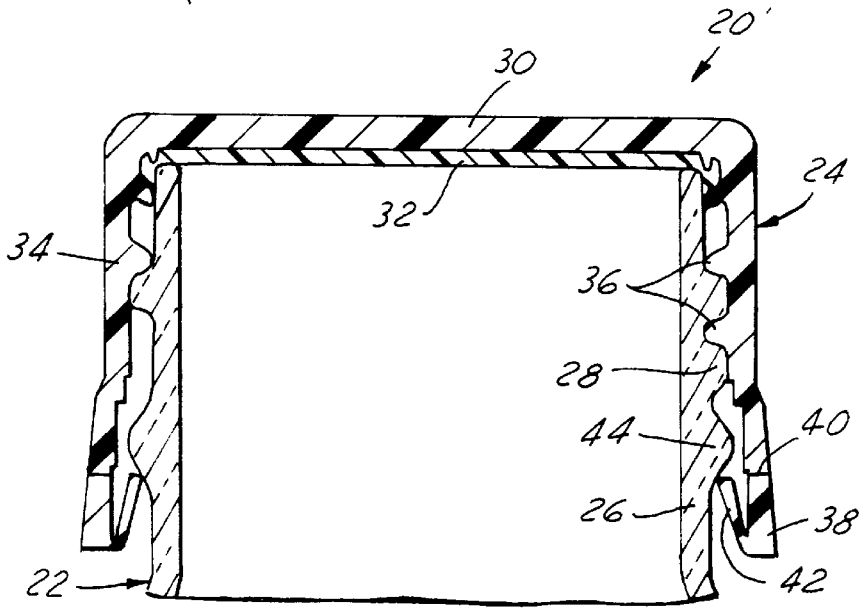
FIG. 2 is a fragmentary sectional view diametrically bisecting the container finish and closure in the embodiment of FIG. 1.
Figure 3:
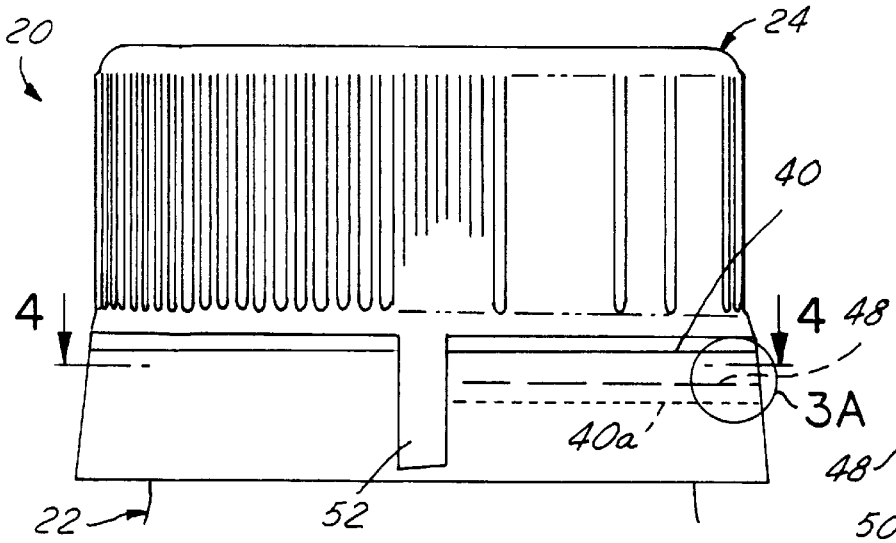
FIG. 3 is an elevational view of the closure in the embodiment of FIGS. 1 and 2.

FIGS. 1–3 illustrate a package 20 in accordance with a presently preferred embodiment of the invention as comprising a container 22 of glass or molded plastic construction and a tamper-indicating closure 24 threaded thereon. Container 22 has an axially extending finish 26 with external threads 28 for receiving closure 24. Closure 24 has a flat base wall 30 on which a sealing liner 32 is secured. An annular peripheral skirt 34 extends downwardly from closure base wall 30, and has internal threads 36 for securing closure 24 over external threads 28 of container 22. A tamper-indicating band 38 is secured to the lower end of skirt 34, being separated therefrom by a circumferential score 40. A stop ring or flange 42 extends radially inwardly and axially upwardly from the lower end of band 34 to a position beneath a radially outwardly extending bead 44 on container 22 beneath threads 28. Closure 24 may be injection molded, or may be compression molded as taught by U.S. Pat. No. 5,554,327. Liner 32 may be separately formed, or more preferably compression molded in situ as shown in U.S. Pat. Nos. 4,984,703 and 5,451,360.

Figure 4:
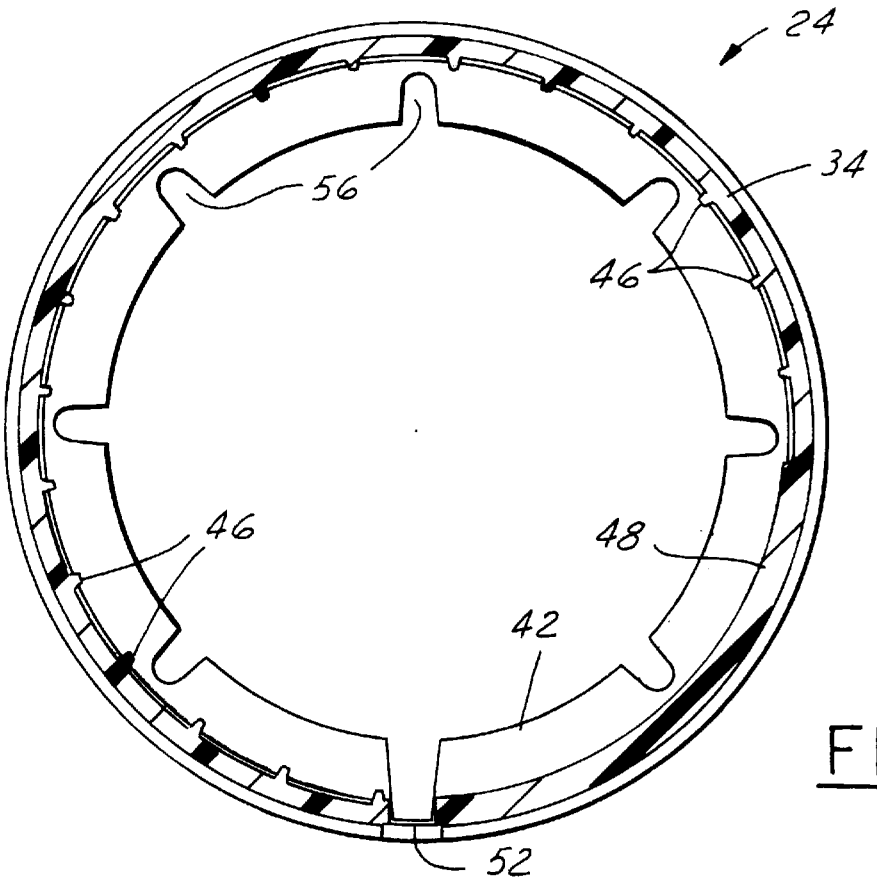
FIG. 4 is a sectional view taken substantially along the line 4—4 FIG. 3.
Figure 5:
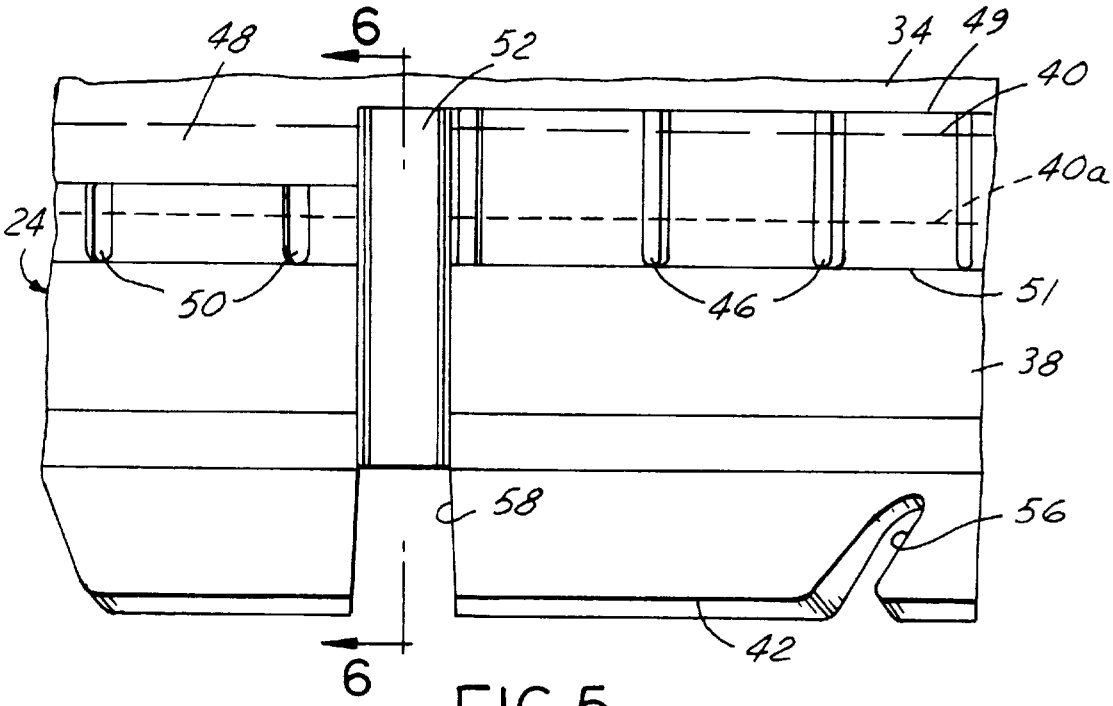
FIG. 5 is a fragmentary inside elevational view of the closure of FIGS. 3 and 4.
Figure 6:
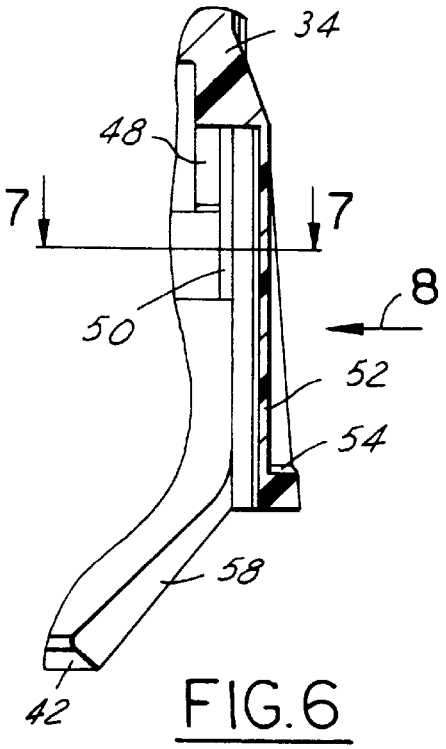
FIG. 6 is a fragmentary sectional view taken substantially along the line 6—6 in FIG. 5.
Figure 7:
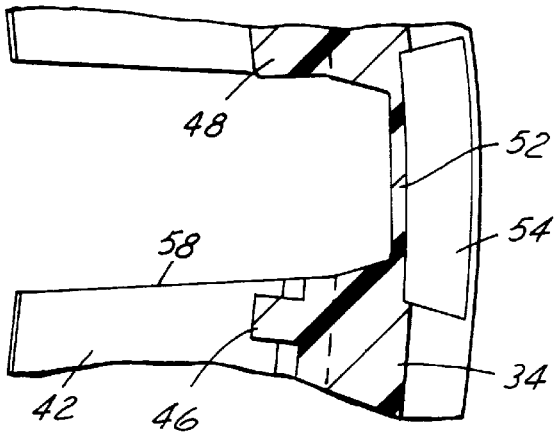
FIG. 7 is a fragmentary sectional view taken substantially along the line 7—7 in FIG. 6.
Figure 8:
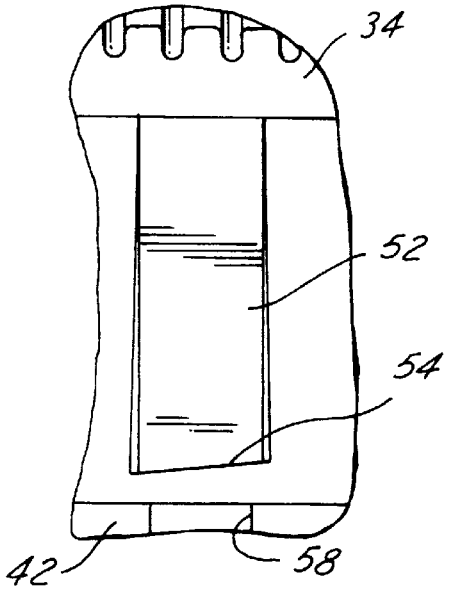
FIG. 8 is a fragmentary outside elevational view taken substantially from the direction 8 in FIG. 6.

FIGS. 4–8 illustrate closure 24 as molded—i.e., before inversion of flange 42, before scoring line 40 and before placement of liner 32 within the closure. Before application of scoreline 40 (FIGS. 2 and 3), tamper-indicating band 38 forms an integral extension of closure skirt 34. A plurality of axially extending bridges are molded on the radially inner surface of skirt 34 and band 38 during the compression-mold forming operation. These bridges in the embodiment of the invention illustrated in FIGS. 4–8 include a plurality of uniformly angularly spaced relatively narrow bridges 46, and a single bridge 48 of extended circumferential dimension. The circumferential dimension of bridge 48 in this embodiment of the invention may be between about 23° and about 90°, more preferably between about 60° and 90°, and most preferably is about 90° in circumferential dimension as shown. Bridges 46 may have an angular dimension of about 1.6° (0.015 inches in a 28 mm closure). As best seen in FIG. 5, the upper edges of bridges 46, 48 lie in a plane 49 disposed beneath threads 36. Bridge 48 preferably is of substantially lesser axial dimension than bridges 46, which is to say that bridges 46 extend downwardly toward flange 42 a greater distance than bridge 48. Short bridges 50 extend downwardly from the lower edge of bridge 48 to a position 51 coplanar with the lower edges of bridges 46.

Tamper-indicating band 38 includes a thin integrally molded membrane 52, which extends from an upper end coplanar with the upper edges of bridges 46, 48 to a lower end at the lower end of band 38. Web 52 is positioned circumferentially clockwise immediately adjacent to the clockwise end of enlarged bridge 48 as viewed from the top of the closure (FIG. 4). Membrane 52 is of substantially rectangular geometry as viewed radially of the closure (FIG. 8), having a lower edge 54 that angulates slightly downwardly away from enlarged bridge 48. Flange 42 has circumferentially spaced scallops 56 that facilitate inversion of the stop ring between the as-molded position of the stop ring illustrated in FIGS. 4–6 and the inverted position of the stop ring illustrated in FIG. 2. A gap 58 extends entirely radially through flange 42 in axial alignment with membrane 52. This gap 58 not only facilitates fracture of the tamper-indicating band as will be described, but also permits exit of mold tooling through flange 42 after molding of the closure including integral membrane 52. Membrane 52 may have circumferential dimension of 0.1 inches for a 28 mm closure, for example, and a thickness in the range of 0.004 to 0.006 inches.

Closure 24 may be injection molded, but more preferably is compression molded in the configuration illustrated in FIGS. 4–8 in accordance with above-noted U.S. Pat. No. 5,554,327. Following the compression molding operation, flange 42 is inverted into the closure as shown in FIG. 3, and the closure is externally circumferentially scored to separate band 38 from skirt 34. This scoring operation preferably is accomplished in accordance with the teachings of U.S. Pat. No. 5,488,888 with a single scoring knife having a continuous cutting edge that externally engages and radially penetrates the circumference of the closure skirt. To form a pigtail-type closure in accordance with the preferred implementation of the invention, the closure is externally radially scored along the scoreline 40 in FIGS. 2–3, 3A and 5–6. The scoring knife does not penetrate entirely through the closure skirt (see FIG. 3A), leaving the skirt coupled to the closure by the upper ends of bridges 46 and the upper end of bridge 48 of enlarged circumferential dimension. The liner 32 is compression molded or otherwise positioned within the closure, and the closure is applied to a container in the usual manner.

Figure 9:
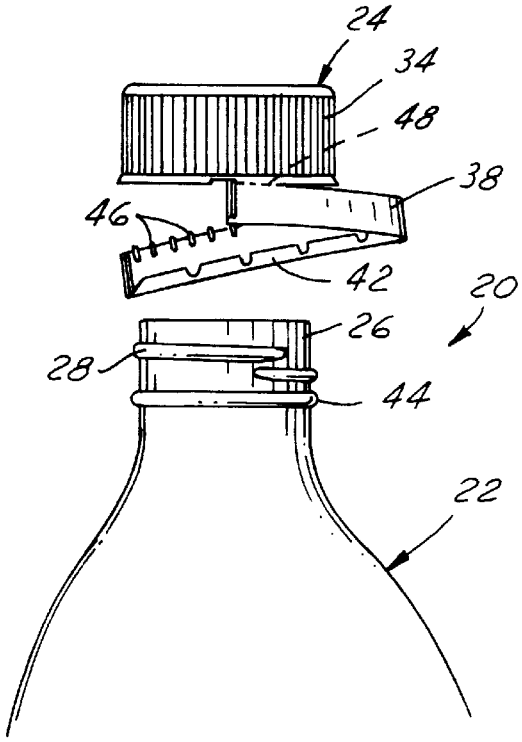
FIG. 9 is a fragmentary elevational view that illustrates removal of the closure from the container in the embodiment of FIGS. 1–8.

When it is attempted to remove the closure from the container, flange 42 engages the lower edge of container bead 44 (FIG. 2) to resist removal of the closure. Continued unthreading of the closure causes fracture of relatively thin bridges 46 and thin membrane 52. However, the enlarged dimension of bridge 48 functions to resist fracture, so that band 38 remains connected to skirt 26 by circumferentially enlarged bridge 48. The resulting "pigtail" configuration of tamper-indicating band 38 is illustrated in FIG. 9. Membrane 52 provides an axially oriented fracture zone adjacent to the clockwise end of enlarged bridge 48 so that the end of band 38 becomes separated from the portion of band 38 immediately beneath bridge 48. Thus, the enlarged dimension of bridge 48 permits a continuous circumferential score 40 to be formed in the periphery of the closure skirt, removing any necessity for having to orient the closure with respect to the score tooling.

Figure 3A:
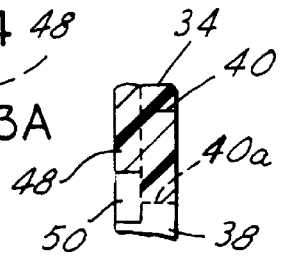
FIG. 3A is an enlarged sectional view of the portion of FIG. 3 within the circle 3A.

A significant feature of the present invention will be appreciated with particular reference to FIGS. 3, 3A and 5. That is, if the score tooling, is adjusted to position the circumferential score at 40*a* instead of at 40, the scoreline will be disposed beneath the plane of the lower edge of bridge 48. At this score position, bridge 48 will be ineffective to retain one end of the tamper-indicating band integral with the closure skirt, and the tamper-indicating band 38 will become completely separated from the closure upon removal of the closure from the container, and thereby function as a conventional drop-band that remains with the container after removal of the closure. Thus, either a pigtail-type tamper-indicating closure or drop-band tamper-indicating closure may be formed employing the same closure mold tooling and the same score tooling with minor adjustment of the score tooling between score positions 40, 40*a*.

The invention has also been described in connection with bridges 46, 48, 50 integrally molded on the inside surface of the closure skirt and tamper-indicating band. However, it will be appreciated that the principles of the invention in their broadest aspects may also be implemented in systems where the bridges are formed by scoring knives, as in above-noted U.S. Pat. No. 5,488,888. However, such a configuration is not preferred because it would then be necessary to orient the closure with respect to the score tooling to make sure that membrane 52 is positioned adjacent to enlarged bridge 48 formed by the scoring knives.

Figure 10:
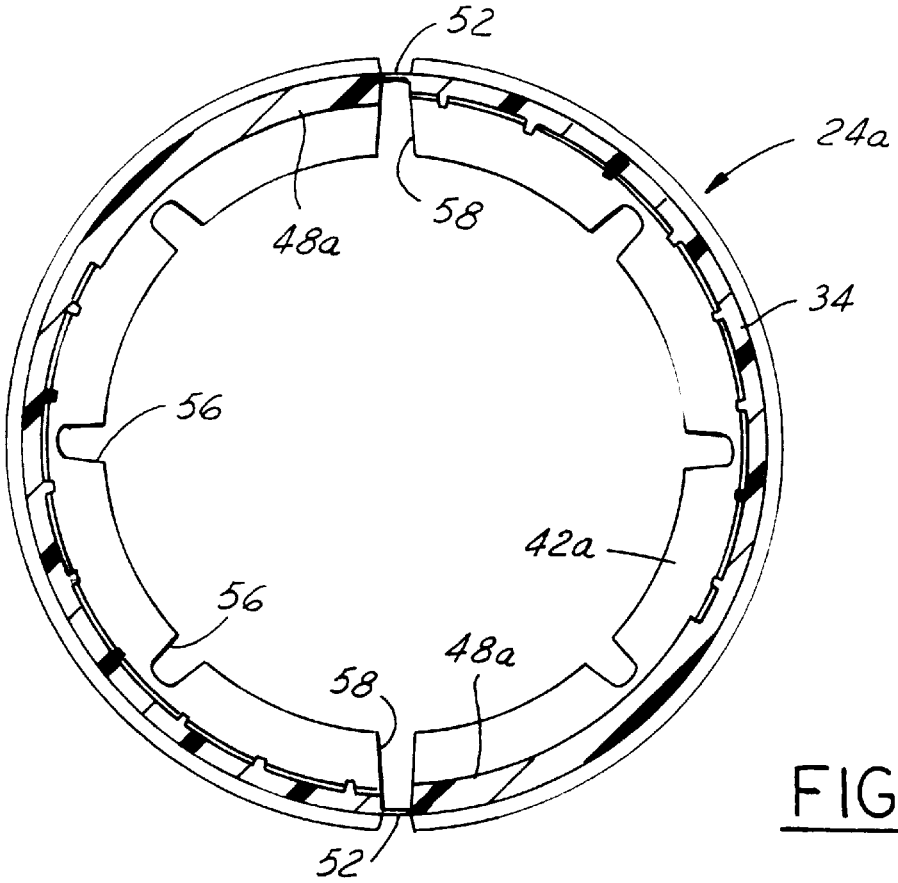
FIG. 10 is a sectional view similar to that of FIG. 4 but illustrating a modified embodiment of the invention.
Figure 11:
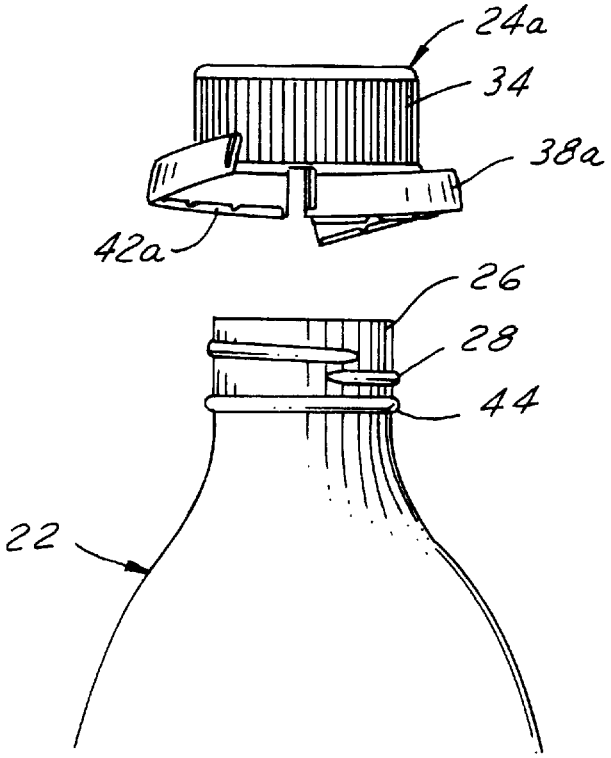
FIG. 11 is a fragmentary elevational view similar to that of FIG. 9 but illustrating operation of the embodiment of FIG. 10.

FIGS. 10 and 11 illustrate a modified closure 24*a* in accordance with the present invention embodying identical diametrically opposed circumferentially enlarged bridges 48*a*, each having a thin membrane 52 positioned clockwise (viewed from the closure top) circumferentially adjacent thereto. Flange 42*a* has diametrically opposed gaps 58 that extend radially entirely through the stop ring from the inner diameter thereof to a position immediately axially aligned with the associated membrane 52. Again, the gaps 58 facilitate fracture of band 38*a*, and provide for passage of mold tooling away from membranes 52*a* after formation. Thus, closure 24*a* is configured such that tamper-indicating band 38*a* will form two diametrically opposed pigtails when the closure is removed from a container, as illustrated in FIG. 11. Bridges 48*a* each have a circumferential dimension between about 23° and 60°, and are preferably on the order of about 60° in circumferential dimension as illustrated in FIG. 10.

Figure 12:
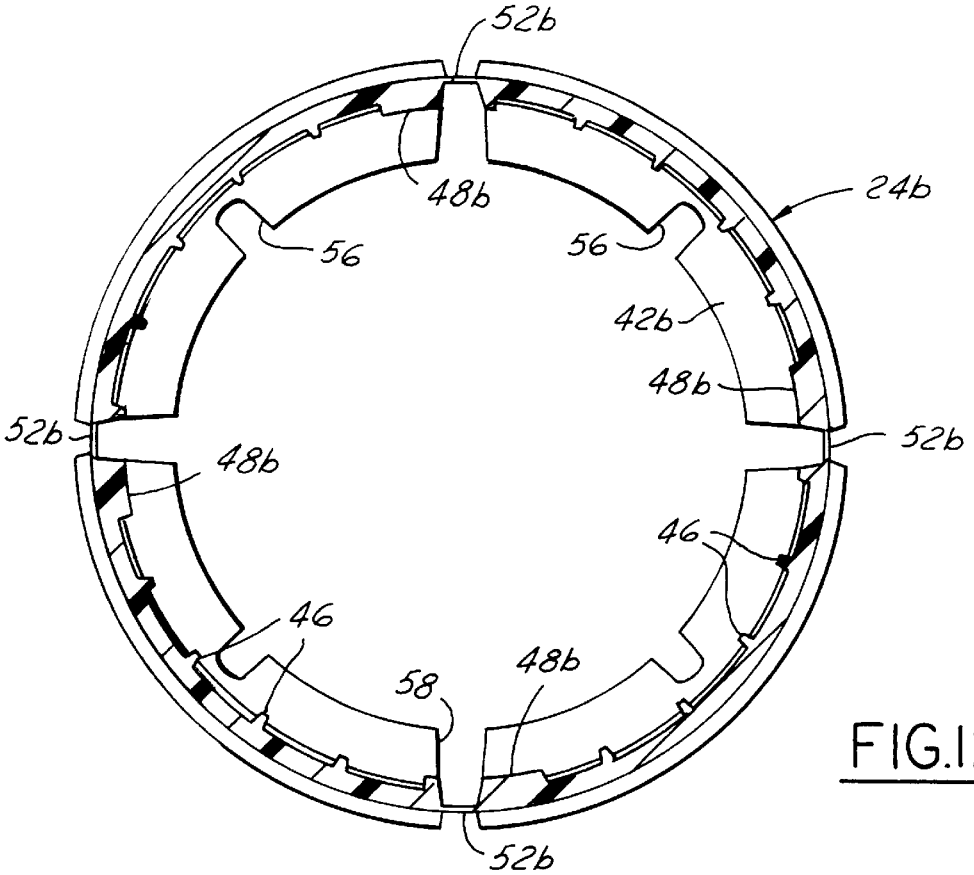
FIG. 12 is a sectional view similar to that of FIG. 4 but illustrating a third embodiment of the invention.
Figure 13:
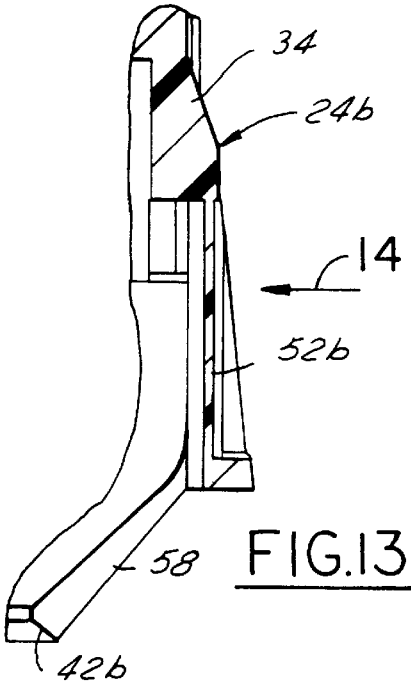
FIGS. 13 and 14 are fragmentary views similar to those of FIGS. 6 and 8 but illustrating the embodiment of FIG. 12.
Figure 14:
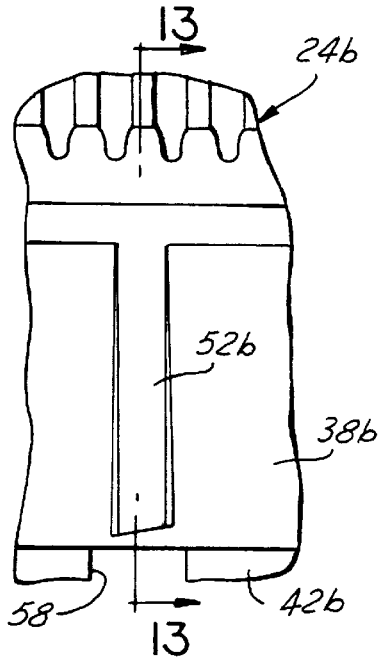

FIGS. 12–14 illustrate a modified closure 24*b*, in which tamper-indicating band 38*b* is configured to provide four pigtails when the closure is removed from a container. There are four circumferentially spaced circumferentially elongated bridges 48*b* positioned at 90° spacing from each other. There are four thin membrane sections 52*b* in the closure skirt, each immediately clockwise adjacent to an associated bridge 48*b*. Flange 42*b* has a gap 58 in alignment with each membrane 52*b* for permitting passage of mold tooling, etc., as previously described. Bridges 48*b* in this four-pigtail embodiment of the invention preferably have an angular dimension of about 23°. FIGS. 13 and 14 illustrate a modified membrane section 52*b*, in which the thin membrane extends to the lower edge and opens axially at the lower edge of band 48*b* in alignment with gap 58*b*.

Figure 15:
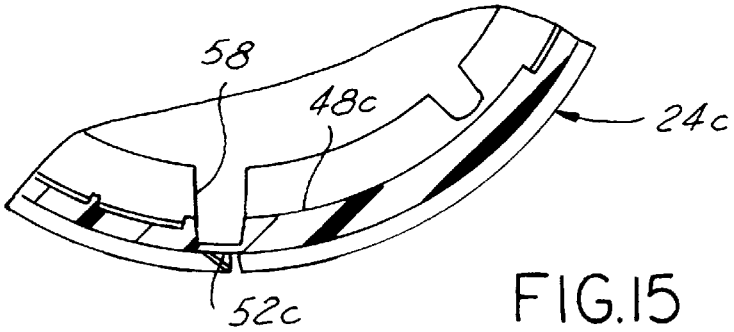
FIG. 15 is a fragmentary sectional view similar to a portion of FIG. 4 but illustrating yet another embodiment of the invention.
Figure 16:
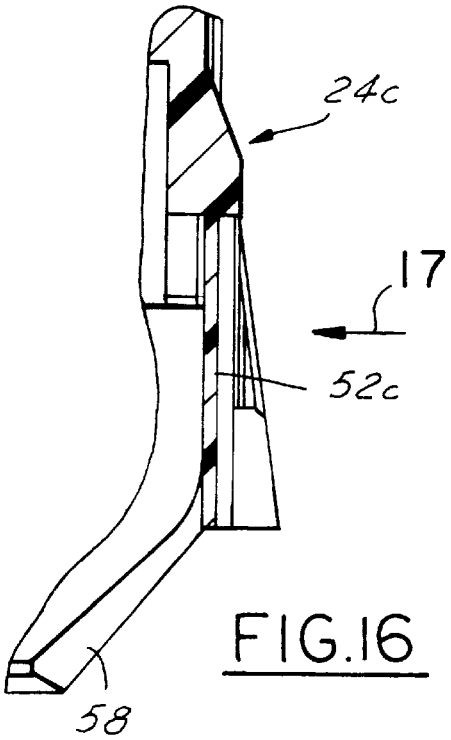
FIGS. 16 and 17 are fragmentary views similar to those of FIGS. 6 and 8 but illustrating the embodiment of FIG. 15.
Figure 17:
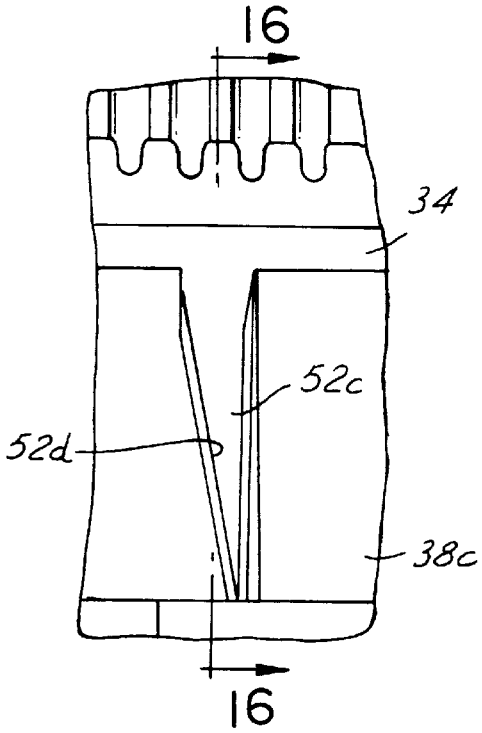

FIGS. 15–17 illustrate a modified closure 24*c* that is similar to closure 24 in FIGS. 4–8, but embodies a modified configuration of membrane 52*c*. In particular, membrane 52*c* has the configuration of a right triangle as viewed from radially outside of the closure (FIG. 17), with the straight or right-angle edge of the triangle extending axially from skirt 34 into band 38*c* at a position clockwise adjacent to circumferentially enlarged bridge 48*c*. The purpose of this membrane configuration is to provide an angulated edge 52*d* to guide fracture of membrane during removal of the closure.

What is claimed is:

1. A tamper-indicating closure of integrally molded plastic construction, which comprises:

a base wall having a peripheral skirt with an internal thread for engaging an external thread on a container finish and an internal wall surface on a side of said thread remote from said base wall, a circumferential array of bridges integrally extending axially along and projecting radially inwardly from said internal surface, at least one of said bridges having a greater circumferential dimension than other of said bridges, a score extending circumferentially around said skirt and radially into said skirt to separate a tamper-indicating band from a lower portion of said skirt, said band remaining integrally connected to said skirt by said bridges, a thin membrane in said band immediately circumferentially adjacent to said one bridge and extending both axially and circumferentially of said band, and a stop flange that extends axially and radially from said band for engaging a bead on a container to inhibit removal of said closure, said stop flange containing a gap in radial alignment with said membrane for both weakening said stop flange and permitting passage of mold tooling from said membrane, such that said membrane and said other bridges rupture upon removal of the closure but said band remains connected to said closure by said one bridge, said membrane having a geometry viewed radially of the closure selected from the group consisting of a trapezoid having an edge spaced from said skirt that angles axially away from said one bridge, and a right triangle with a base extending along said skirt.

2. The closure set forth in claim 1 comprising a plurality of said bridges of greater circumferential dimension circumferentially spaced from each other.

3. The closure set forth in claim 1 wherein said at least one bridge has a circumferential dimension of between about 23° and about 90°.

4. The closure set forth in claim 3 wherein said at least one bridge has a circumferential dimension of between about 60° and about 90°.

5. The closure set forth in claim 4 wherein said at least one bridge comprises one bridge having a circumferential dimension of about 90°.

6. The closure set forth in claim 4 wherein said at least one bridge comprises two bridges diametrically opposed to each and each having a circumferential dimension of about 60°.

7. The closure set forth in claim 3 wherein said at least one bridge comprises four bridges at 90° spacing from each other and each having a circumferential dimension of about 23°.

8. The closure set forth in claim 1 wherein said at least one bridge has a lesser axial dimension than said other bridges.

9. The closure set forth in claim 8 further comprising bridges extending axially from said one bridge and having circumferential dimensions identical to those of said other bridges.

10. A tamper-indicating package that comprises:

a container having a finish with an external thread and an annular bead beneath the thread, and a closure that includes a base wall having a peripheral skirt with an internal thread for engaging an external thread on a container finish and an internal wall surface on a side of said thread remote from said base wall, a circumferential array of bridges integrally extending axially along and projecting radially inwardly from said internal surface, at least one of said bridges having a greater circumferential dimension than other of said bridges, a score extending circumferentially around said skirt and radially into said skirt to separate a tamper-indicating band from a lower portion of said skirt, said band remaining integrally connected to said skirt by said bridges, a thin membrane in said band immediately circumferentially adjacent to said one bridge and extending both axially and circumferentially of said band, and a stop flange that extends axially and radially from said band for engaging a bead on a container to inhibit removal of said closure, said stop flange containing a gap in radial alignment with said membrane for both weakening said stop flange and permitting passage of mold tooling from said membrane, such that said membrane and said other bridges rupture upon removal of the closure but said band remains connected to said closure by said one bridge, said membrane having a geometry viewed radially of the closure selected from the group consisting of a trapezoid having an edge spaced from said skirt that angles axially away from said one bridge, and a right triangle with a base extending along said skirt.

11. The package set forth in claim 10 comprising a plurality of said bridges of greater circumferential dimension circumferentially spaced from each other.

12. The package set forth in claim 10 wherein said at least one bridge has a circumferential dimension of between about 23° and about 90°.

13. The package set forth in claim 12 wherein said at least one bridge has a circumferential dimension of between about 60° and about 90°.

14. The package set forth in claim 13 wherein said at least one bridge comprises one bridge having a circumferential dimension of about 90°.

15. The package set forth in claim 12 wherein said at least one bridge comprises two bridges diametrically opposed to each and each having a circumferential dimension of about 60°.

16. The package set forth in claim 12 wherein said at least one bridge comprises four bridges at 90° spacing from each other and each having a circumferential dimension of about 23°.

17. The package set forth in claim 10 wherein said at least one bridge has a lesser axial dimension than said other bridges.

18. The package set forth in claim 17 further comprising bridges extending axially from said one bridge and having circumferential dimensions identical to those of said other bridges.

19. A tamper-indicating closure of integrally molded plastic construction, which comprises:

a base wall having a peripheral skirt with an internal thread for engaging an external thread on a container, An annular tamper-indicating band integrally axially extending from said skirt, a plurality of circumferentially spaced bridges molded on an internal face of said skirt and extending axially into said band, at least one of said bridges having a greater circumferential dimension than other of said bridges but lesser axial dimension into said band, a thin integrally molded membrane in said band immediately circumferentially adjacent to said one bridge and extending both axially and circumferentially of said band, and stop means on said band for engaging a bead on the container to inhibit removal of the closure from the container, said closure being adapted to be externally circumferentially scored to separate said band from said skirt, with said score being axially spanned by said other bridges, and with said band being adapted to be removed with the closure from the container when the score intersects said one bridge, and being adapted to remain on the container when the closure is removed when the score does not intersect said one bridge.

20. The closure set forth in claim 19 comprising a plurality of said bridges of greater circumferential dimension circumferentially spaced from each other.

21. The closure set forth in claim 20 further comprising bridges extending axially from said at least one bridge into said band and having a circumferential thickness equal to those of said other bridges.

22. The closure set forth in claim 20 wherein said stop means comprises a stop flange that extends axially and radially from said band, said stop flange containing a gap in radial alignment with said membrane both for weakening said stop ring and permitting passage of mold tooling from said membrane.

* * * * *